US011428183B2

(12) United States Patent
Kato et al.

(10) Patent No.: US 11,428,183 B2
(45) Date of Patent: Aug. 30, 2022

(54) ELECTROMAGNETIC VALVE DRIVING DEVICE

(71) Applicants: Hitachi Astemo, Ltd., Hitachinaka (JP); Nuvoton Technology Corporation Japan, Nagaokakyo (JP)

(72) Inventors: Motoaki Kato, Hitachinaka (JP); Atsushi Ogawa, Hitachinaka (JP); Kengo Nomura, Hitachinaka (JP); Keisuke Kuroda, Osaka (JP)

(73) Assignees: HITACHI ASTEMO, LTD., Ibaraki (JP); NUVOTON TECHNOLOGY CORPORATION JAPAN, Kyoto (JP)

( * ) Notice: Subject to any disclaimer, the term of this patent is extended or adjusted under 35 U.S.C. 154(b) by 0 days.

(21) Appl. No.: 17/487,444

(22) Filed: Sep. 28, 2021

(65) Prior Publication Data

US 2022/0099042 A1 Mar. 31, 2022

(30) Foreign Application Priority Data

Sep. 30, 2020 (JP) ..... JP2020-164324

(51) Int. Cl.
*F02D 41/20* (2006.01)

(52) U.S. Cl.
CPC ..... *F02D 41/20* (2013.01); *F02D 2041/202* (2013.01); *F02D 2041/2003* (2013.01); *F02D 2041/2006* (2013.01); *F02D 2041/2051* (2013.01)

(58) Field of Classification Search
CPC ..... F02D 41/20; F02D 2041/2003–2096
See application file for complete search history.

(56) References Cited

U.S. PATENT DOCUMENTS

2015/0188328 A1* 7/2015 Abouda ..... H03K 17/162 123/478
2021/0301748 A1* 9/2021 Sumisha ..... F02D 41/20

FOREIGN PATENT DOCUMENTS

JP 2018031294 A 3/2018

* cited by examiner

*Primary Examiner* — Hung Q Nguyen
*Assistant Examiner* — Mark L. Greene
(74) *Attorney, Agent, or Firm* — Cantor Colburn LLP

(57) ABSTRACT

An electromagnetic valve driving device that drives an electromagnetic valve for injecting a fuel, includes: a first charging route that charges a bootstrap capacitor from a battery without intervention of a boost circuit; a second charging route that charges the bootstrap capacitor from the boost circuit; and a switching control unit that switches a charging route for charging the bootstrap capacitor to the first charging route or the second charging route.

4 Claims, 5 Drawing Sheets

ELECTROMAGNETIC VALVE DRIVING DEVICE

CROSS REFERENCE TO RELATED APPLICATIONS

The present invention claims priority under 35 U.S.C. § 119 to Japanese Patent Application No. 2020-164324, filed Sep. 30, 2020, the content of which is incorporated herein by reference.

BACKGROUND OF THE INVENTION

Field of the Invention

The present invention relates to an electromagnetic valve driving device.

Description of Related Art

Japanese Unexamined Patent Application, First Publication No. 2018-31294 discloses an electromagnetic valve driving device adapted to open a fuel injection valve through energization of a solenoid coil of the fuel injection valve.

The electromagnetic valve driving device has a switching element on a high side (hereinafter, referred to as a "high-side switching element") and a switching element on a low side (hereinafter, referred to as a "low-side switching element"). The electromagnetic valve driving device energizes the solenoid coil with either a battery voltage or a boosted voltage obtained by boosting the battery voltage, through control of turning each of the high-side switching element and the low-side switching element into an ON state.

The electromagnetic valve driving device includes a bootstrap circuit adapted to generate a voltage (hereinafter, referred to as a "boot voltage") for control of turning the high-side switching element into an ON state in some cases. The bootstrap circuit includes a diode and a capacitor and generates the boot voltage by charging the capacitor.

In order to generate the boot voltage, it is necessary to generate a voltage (hereinafter, referred to as a "charging voltage") to charge the capacitor. Thus, the electromagnetic valve driving device in the related art generates the charging voltage by dropping the boosted voltage to a predetermined voltage.

However, the dropping of the boosted voltage to the predetermined voltage leads to a large power loss. Thus, the present inventors contrived an idea of generating the charging voltage from the battery voltage. However, situations in which the battery voltage is lowered or becomes unstable for various reasons such as a vehicle traveling state or an abnormality are assumed, and there is a concern that it may not be possible to stably generate the boot voltage.

SUMMARY OF THE INVENTION

The present invention was made in view of such circumstances, and an object thereof is to provide an electromagnetic valve driving device capable of stably generating a boot voltage for control of turning a high-side switching element into an ON state.

(1) According to an aspect of the present invention, there is provided an electromagnetic valve driving device that receives power from a battery and drives a fuel injection valve having a solenoid coil, the electromagnetic valve driving device including: a boost circuit that boosts a battery voltage, which is an output voltage of the battery; a first switching element that is disposed between the boost circuit and a first end of the solenoid coil; a second switching element that is disposed between the battery and the first end; a third switching element that is disposed between a second end of the solenoid coil and a ground; a fourth switching element that is disposed between the first end and the ground; a bootstrap capacitor that generates a voltage necessary to turn the first switching element and the second switching element into an ON state; a first charging route that charges the bootstrap capacitor from the battery without intervention of the boost circuit; a second charging route that charges the bootstrap capacitor from the boost circuit; and a switching control unit that switches a charging route for charging the bootstrap capacitor to the first charging route or the second charging route.

(2) The electromagnetic valve driving device in (1) above may further include: a first voltage generation unit that is provided in the first charging route and generates a voltage for charging the bootstrap capacitor by dropping the battery voltage; and a second voltage generation unit that is provided in the second charging route and generates a voltage for charging the bootstrap capacitor by dropping a boosted voltage boosted by the boost circuit.

(3) In the electromagnetic valve driving device in (1) above, the switching control unit may switch the charging route from the first charging route to the second charging route in a case in which the battery voltage is below a predetermined value.

(4) In the electromagnetic valve driving device in (2) above, the switching control unit may switch the charging route from the first charging route to the second charging route in a case in which the battery voltage is below a predetermined value.

According to the electromagnetic valve driving device of the aforementioned aspect, it is possible to stably generate a boot voltage for control of turning a high-side switching element into an ON state.

DETAILED DESCRIPTION OF THE INVENTION

Hereinafter, an electromagnetic valve driving device according to an embodiment will be described using the drawings.

An electromagnetic valve driving device 1 according to the present embodiment is a driving device that drives a fuel injection valve L. Specifically, the electromagnetic valve driving device 1 according to the present embodiment is an electromagnetic valve driving device that drives, as a drive target, the fuel injection valve L (electromagnetic valve) that injects a fuel into an internal combustion engine mounted in a vehicle.

The fuel injection valve L is an electromagnetic valve (solenoid valve) that injects a fuel into an internal combustion engine such as a gasoline engine or a diesel engine mounted in a vehicle.

Hereinafter, a configuration example of the fuel injection valve L will be described using FIG. 1.

Figure 1:
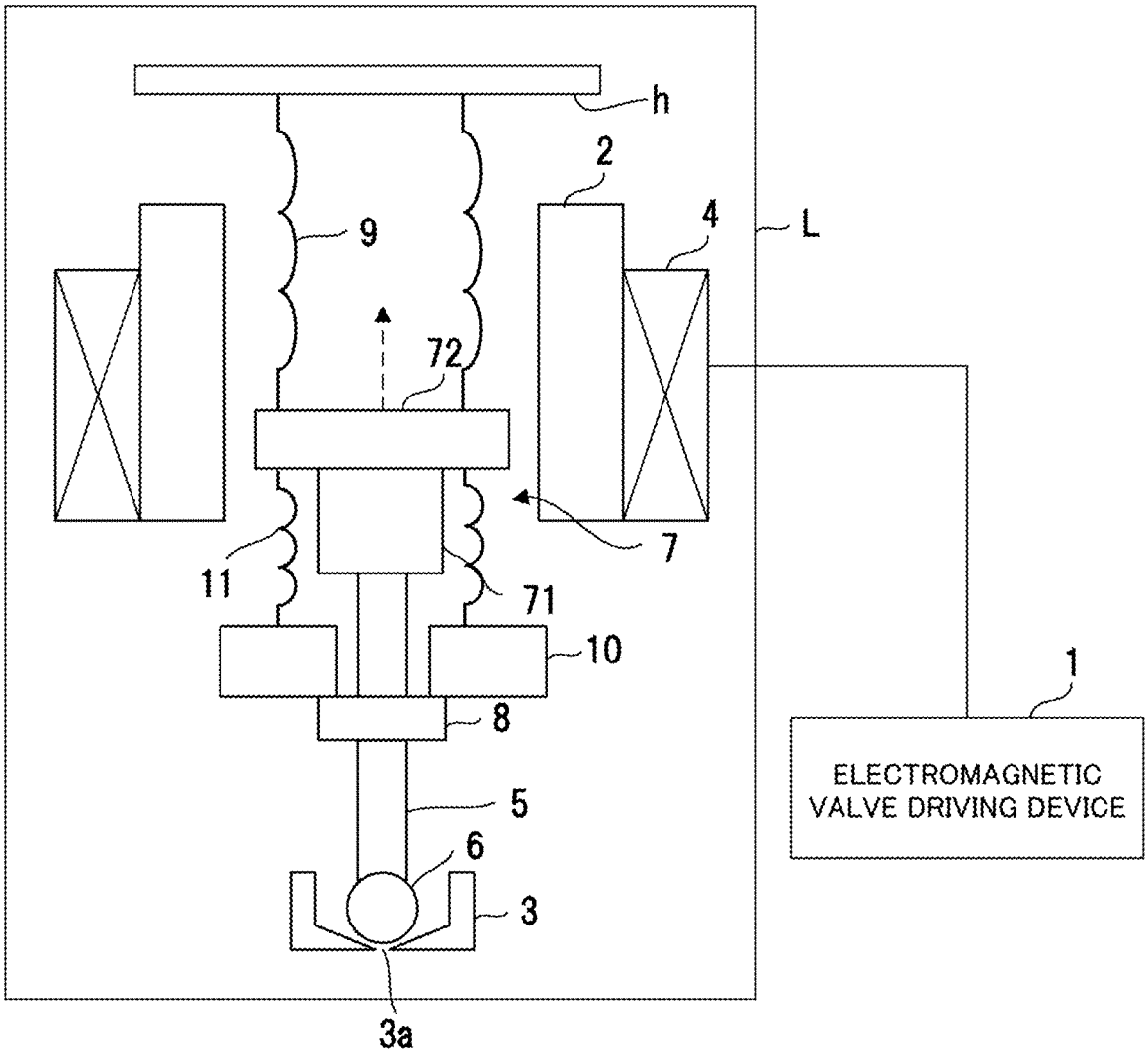
FIG. 1 is a schematic diagram illustrating a configuration example of a fuel injection valve according to an embodiment.

As illustrated in FIG. 1, the fuel injection valve L includes a secured core 2, a valve seat 3, a solenoid coil 4, a needle 5, a valve body 6, a retainer 7, a lower stopper 8, a valve body biasing spring 9, a movable core 10, and a movable core biasing spring 11. In the present embodiment, the secured core 2, the valve seat 3, and the solenoid coil 4 are secured members while the needle 5, the valve body 6, the retainer 7, the lower stopper 8, the valve body biasing spring 9, the movable core 10, and the movable core biasing spring 11 are movable members.

The secured core 2 is a cylindrical member and is secured to a housing (not illustrated) of the fuel injection valve L. The secured core 2 is formed of a magnetic material.

The valve seat 3 is secured to the housing of the fuel injection valve L. The valve seat 3 has an injection hole 3*a*.

The injection hole 3*a* is a hole from which a fuel is injected, is closed in a case in which the valve body 6 is seated in the valve seat 3, and is opened in a case in which the valve body 6 is separated from the valve seat 3.

The solenoid coil 4 is formed by winding an electric wire into an annular shape. The solenoid coil 4 is disposed concentrically with the secured core 2.

The solenoid coil 4 is electrically connected to the electromagnetic valve driving device 1. The solenoid coil 4 forms a magnetic path including the secured core 2 and the movable core 10 by being energized by the electromagnetic valve driving device 1.

The needle 5 is a long bar member extending along a center axis of the secured core 2. The needle 5 moves in an axial direction (an extending direction of the needle 5) of the center axis of the secured core 2 due to an attraction force generated by the magnetic path including the secured core 2 and the movable core 10. Note that in the following description, a direction in which the movable core 10 moves due to the attraction force will be referred to as toward an upper side, and a direction opposite to the direction in which the movable core 10 moves due to the attraction force will be referred to as a toward lower side, in the axial direction of the center axis of the secured core 2.

The valve body 6 is formed at a lower end of the needle 5. The valve body 6 closes the injection hole 3*a* by being seated in the valve seat 3 and opens the injection hole 3*a* by being separated from the valve seat 3.

The retainer 7 includes a guide member 71 and a flange 72.

The guide member 71 is a cylindrical member secured to an upper end of the needle 5.

The flange 72 is provided at an upper end of the guide member 71. The flange 72 is formed to project in a radial direction of the needle 5. In other words, the flange 72 has a larger outer diameter dimension than the guide member 71.

A lower end surface of the flange 72 is a surface abutting on the movable core biasing spring 11. An upper end surface of the flange 72 is a surface abutting on the valve body biasing spring 9.

The lower stopper 8 is a cylindrical member secured to the needle 5 at a position between the valve seat 3 and the guide member 71. An upper end surface of the lower stopper 8 is a surface abutting on the movable core 10.

The valve body biasing spring 9 is a compression coil spring accommodated inside the secured core 2 and is inserted between an inner wall surface h of the housing and the flange 72. The valve body biasing spring 9 biases the valve body 6 downward. In other words, the valve body 6 is caused to abut on the valve seat 3 due to a biasing force of the valve body biasing spring 9 in a case in which the solenoid coil 4 is not energized.

The movable core 10 is disposed between the guide member 71 and the lower stopper 8. The movable core 10 is a cylindrical member and is provided coaxially with the needle 5. The movable core 10 includes a through-hole formed at the center thereof such that the needle 5 is inserted, and can move along the extending direction of the needle 5.

An upper end surface of the movable core 10 is a surface abutting on the secured core 2 and the movable core biasing spring 11. On the other hand, a lower end surface of the movable core 10 is a surface abutting on the lower stopper 8. The movable core 10 is formed of a magnetic material.

The movable core biasing spring 11 is a compression coil spring inserted between the flange 72 and the movable core 10. The movable core biasing spring 11 biases the movable core 10 downward. In other words, the movable core 10 is caused to abut on the lower stopper 8 due to a biasing force of the movable core biasing spring 11 in a case in which the solenoid coil 4 is not energized.

Next, the electromagnetic valve driving device 1 according to the present embodiment will be described.

Figure 2:
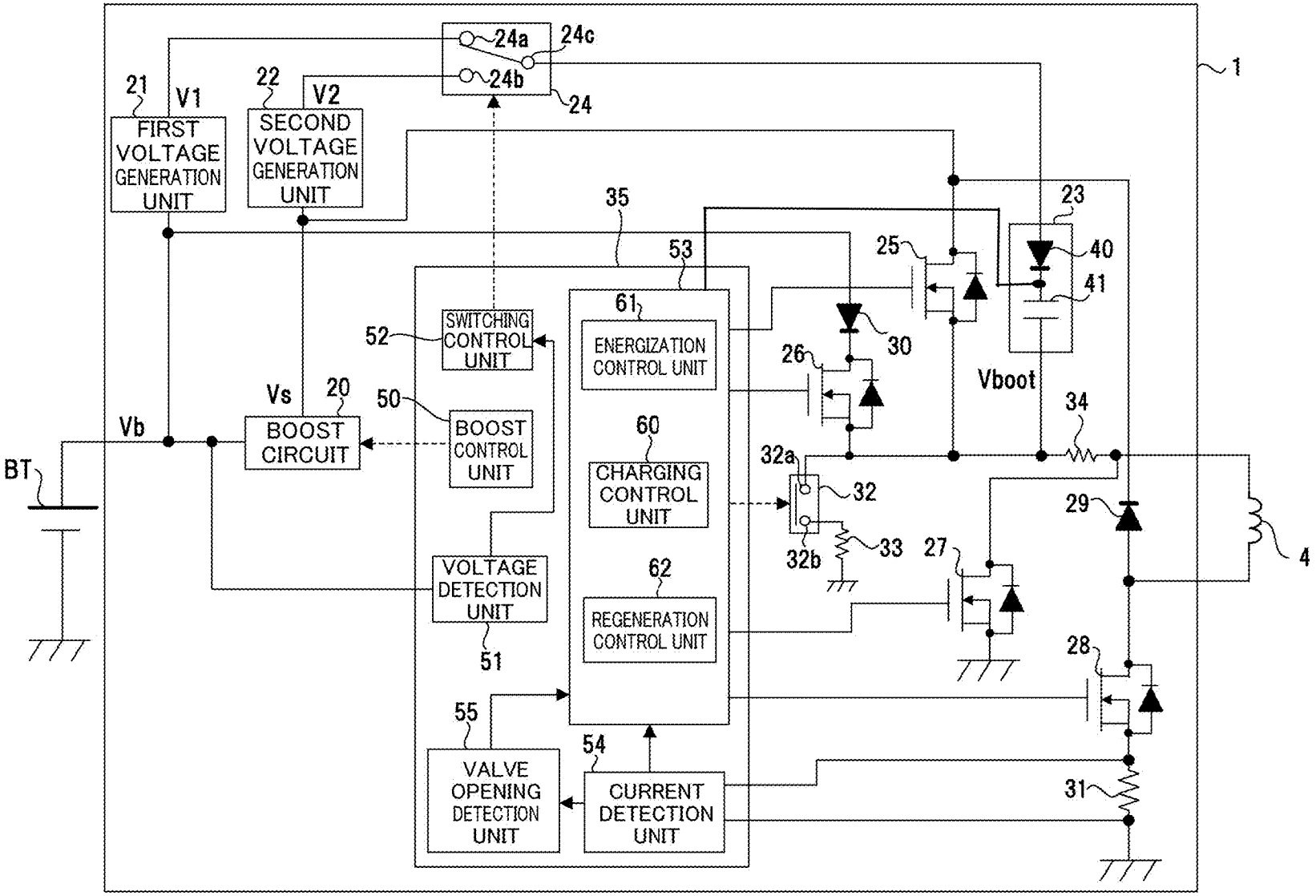
FIG. 2 is a circuit diagram illustrating a configuration example of an electromagnetic valve driving device according to the embodiment.

As illustrated in FIG. 2, the electromagnetic valve driving device 1 includes a boost circuit 20, a first voltage generation unit 21, a second voltage generation unit 22, a bootstrap circuit 23, a switching unit 24, first to fourth switching elements 25 to 28, a first diode 29, a second diode 30, a current detection resistor 31, a switch 32, a limiting resistor 33, a resistor 34, and a control unit 35. Note that the switch 32 and the like may be mounted in the control unit 35.

The boost circuit 20 boosts a battery voltage (output voltage) Vb input from a battery BT that is mounted in a vehicle to a predetermined voltage. For example, the boost circuit 20 is a chopper circuit. The boost circuit 20 generates a boosted voltage Vs by boosting the battery voltage. The boost circuit 20 has a voltage boosting ratio of about ten to several tens, for example, and operations of the boost circuit 20 are controlled by the control unit 35.

The first voltage generation unit 21 generates a first voltage V1 by dropping the battery voltage Vb. For example, the first voltage generation unit 21 includes a DC-DC converter such as a linear regulator or a switching regulator.

The second voltage generation unit 22 generates a second voltage V2 by dropping the boosted voltage Vs. For example, the second voltage generation unit 22 includes a DC-DC converter such as a linear regulator or a switching regulator. The first voltage V1 and the second voltage V2 are mutually the same voltage value. However, the first voltage V1 and the second voltage V2 may be mutually different voltage values.

The bootstrap circuit 23 generates a voltage (hereinafter, referred to as a "boot voltage") Vboot for control of turning a switching element on a high side (hereinafter, referred to as a "high-side switching element") into an ON state. The high-side switching element is at least either the first switching element 25 or the second switching element 26. The bootstrap circuit 23 generates the boot voltage from any one voltage of the first voltage V1 and the second voltage V2. The bootstrap circuit 23 includes a diode 40 and a bootstrap capacitor 41.

The diode 40 has an anode connected to the switching unit 24 and a cathode connected to the bootstrap capacitor 41.

The bootstrap capacitor 41 has a first end connected to the cathode of the diode 40 and a second end connected to each of sources of the first switching element 25 and the second switching element 26. The bootstrap circuit 23 generates the boot voltage Vboot by the bootstrap capacitor 41 being charged.

Figure 3:
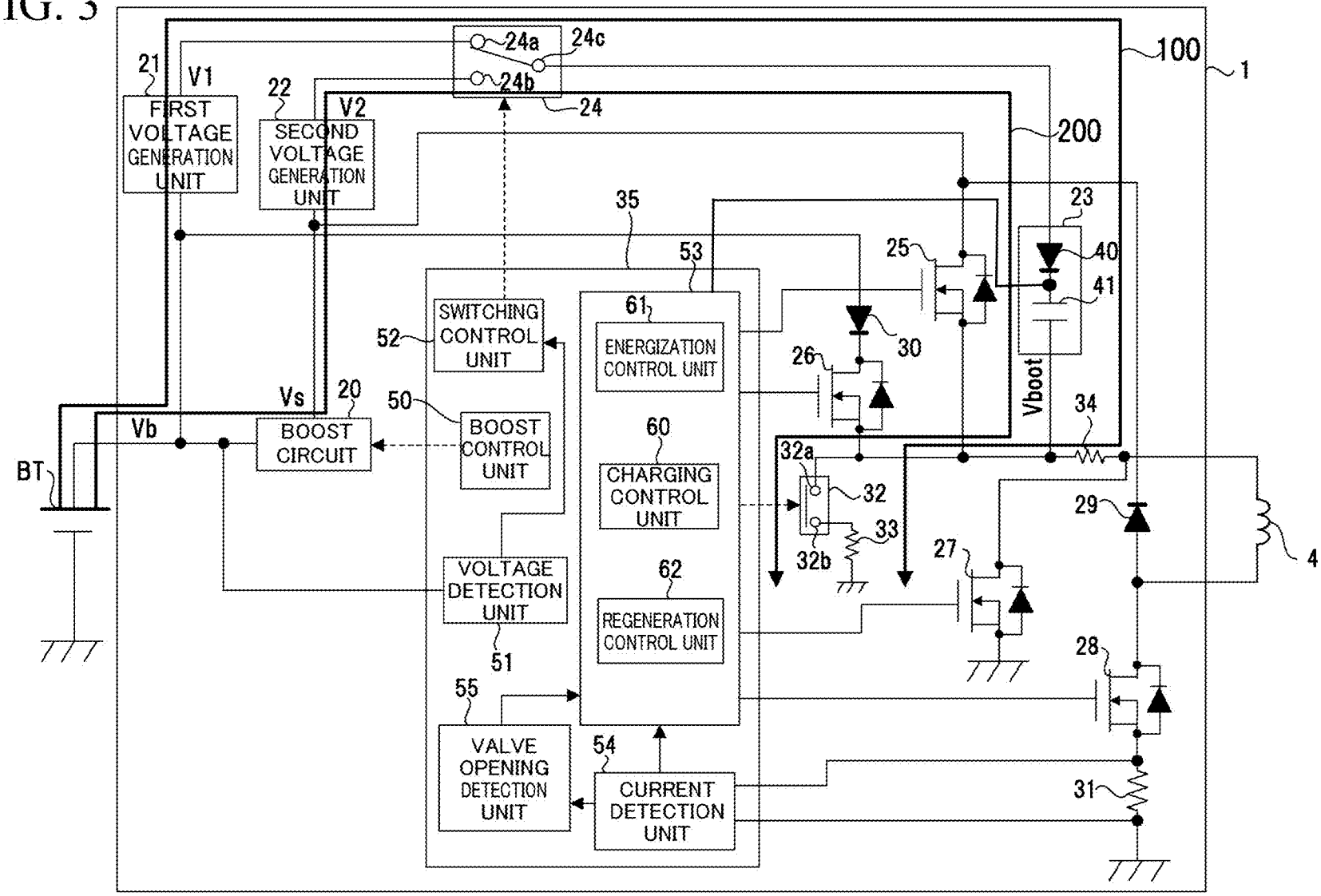
FIG. 3 is a circuit diagram illustrating an example of a first charging route and a second charging route according to the embodiment.

As illustrated in FIG. 3, the switching unit 24 switches a charging route for charging the bootstrap capacitor 41 to a first charging route 100 or a second charging route 200. The first charging route 100 is a route for charging the bootstrap capacitor 41 from the battery BT without intervention of the boost circuit 20. The first charging route 100 in the present embodiment is a route for charging the bootstrap capacitor 41 by applying the first voltage V1 generated by the first voltage generation unit 21 to the bootstrap capacitor 41. However, the first charging route 100 is not limited only to this configuration and may be a route for charging the bootstrap capacitor 41 by applying the battery voltage Vb to the bootstrap capacitor 41.

The second charging route 200 is a route for charging the bootstrap capacitor 41 from the boost circuit 20. The second charging route 200 in the present embodiment is a route for charging the bootstrap capacitor 41 by applying the second voltage V2 generated by the second voltage generation unit 22 to the bootstrap capacitor 41. However, the second charging route 200 is not limited only to this configuration and may be a route for charging the bootstrap capacitor 41 by applying the boosted voltage Vs to the bootstrap capacitor 41.

The configuration of the switching unit 24 is not particularly limited as long as the switching unit 24 can switch the charging route for charging the bootstrap capacitor 41 to the first charging route 100 or the second charging route 200. The switching unit 24 may have a three-way switch, for example.

For example, the switching unit 24 includes a first terminal 24*a*, a second terminal 24*b*, and a third terminal 24*c*. The switching unit 24 can perform switching between a first state in which the first terminal 24*a* and the third terminal 24*c* are electrically connected to each other and a second state in which the second terminal 24*b* and the third terminal 24*c* are electrically connected to each other. The first terminal 24*a* is connected to an output terminal of the first voltage generation unit 21. The second terminal 24*b* is connected to an output terminal of the second voltage generation unit 22. The third terminal 24*c* is connected to an anode of the diode 40. The switching unit 24 switches the charging route for charging the bootstrap capacitor 41 to the first charging route 100 by being controlled such that it is brought into the first state by the control unit 35. The switching unit 24 switches the charging route for charging the bootstrap capacitor 41 to the second charging route 200 by being controlled into the second state by the control unit 35.

The first switching element 25 is, for example, an MOS transistor and is provided between an output end of the boost circuit 20 and the first end of the solenoid coil 4. In other words, the first switching element 25 has a drain connected to an output terminal of the boost circuit 20 and a source connected to the first end of the solenoid coil 4 via the resistor 34. A gate of the first switching element 25 is connected to the control unit 35. ON/OFF (close/open) operations of the first switching element 25 are controlled by the control unit 35.

The second switching element 26 is, for example, an MOS transistor and is provided between an output terminal of the battery BT and the first end of the solenoid coil 4. The second switching element 26 has a drain connected to the output terminal of the battery BT via the second diode 30 and a source connected to the first end of the solenoid coil 4 via the resistor 34. A gate of the second switching element 26 is connected to the control unit 35. ON/OFF (close/open) operations of the second switching element 26 are controlled by the control unit 35.

The third switching element 27 is, for example, an MOS transistor, and has a drain connected to the first end of the solenoid coil 4 and a source connected to GND (reference potential/ground). A gate of the third switching element 27 is connected to the control unit 35. ON/OFF (close/open) operations of the third switching element 27 are controlled by the control unit 35. The third switching element 27 is a switch for forming a route of a regenerative current by being turned into an ON state (open state).

The fourth switching element 28 is, for example, an MOS transistor, has a drain connected to the second end of the solenoid coil 4, and has a source connected to the first end of the current detection resistor 31. The fourth switching element 28 has a gate connected to the control unit 35. ON/OFF (close/open) operations of the fourth switching element 28 are controlled by the control unit 35.

The first diode 29 has a cathode connected to the output terminal of the boost circuit 20 and has an anode connected to the second end of the solenoid coil 4.

The second diode 30 has a cathode connected a drain of the second switching element 26 and has an anode connected to the output terminal of the battery BT. The second diode 30 is a diode for preventing a backward flow. The second diode 30 prevents an output current of the boost circuit 20 from flowing into the output end of the battery BT in a case in which both the first switching element 25 and the second switching element 26 are turned into an ON state.

The current detection resistor 31 is a shunt resistor that has a first end connected to a source of the fourth switching element 28 and has a second end connected to the GND (reference potential). The current detection resistor 31 is connected to the solenoid coil 4 in series via the fourth switching element 28, and a current flowing through the solenoid coil 4 passes therethrough. The current detection resistor 31 generates a voltage (hereinafter, referred to as a "detection voltage") in accordance with a magnitude of the current flowing through the solenoid coil 4 between the first end and the second end.

The switch 32 is connected between the bootstrap circuit 23 and the GND (reference potential). The switch 32 includes a first terminal 32*a* and a second terminal 32*b* and can perform switching between an ON state in which the first terminal 32*a* and the second terminal 32*b* are electrically connected to each other and an OFF state in which the connection therebetween is released. The first terminal 32*a* is connected to a second end of the bootstrap capacitor 41. The second terminal 32*b* is connected to a first end of the limiting resistor 33. The switch 32 is a switch for charging the bootstrap capacitor 41.

The limiting resistor 33 has a first end connected to the switch 32 and a second end connected to the GND (reference potential).

The resistor 34 has a first end connected to the second end of the bootstrap capacitor 41 and a second end connected to the first end of the solenoid coil 4.

The control unit 35 controls the boost circuit 20, the switching unit 24, and the first to fourth elements 25 to 28 on the basis of command signals input from a higher order control system. For example, the control unit 35 is an integrated circuit (IC). Hereinafter, functional units of the control unit 35 will be described.

The control unit 35 includes a boost control unit 50, a voltage detection unit 51, a switching control unit 52, a drive control unit 53, a current detection unit 54, and a valve opening detection unit 55.

The boost control unit 50 performs current feedback control for controlling operations of the boost circuit 20. At this time, a PWM signal (boost control signal) may be used as a control method. In a case in which the PWM signal is used, the boost control unit 50 generates a PWM signal and outputs the PWM signal to the boost circuit 20. In this manner, the boost circuit 20 generates the boosted voltage Vs.

The voltage detection unit 51 detects the battery voltage Vb that is an output from the battery BT. The voltage detection unit 51 outputs the detected battery voltage Vb to the switching control unit 52.

The switching control unit 52 controls switching operations of the switching unit 24. In a case in which the battery voltage Vb detected by the voltage detection unit 51 is below a predetermined value Vth, the switching control unit 52 causes the route for charging the bootstrap circuit 23 to be switched from the first charging route 100 to the second charging route 200. For example, the switching control unit 52 controls the route for charging the bootstrap circuit 23 such that it becomes the first charging route 100 in a case in which the battery voltage Vb is equal to or greater than the predetermined value Vth, and the switching control unit 52 controls the charging route to the second charging route 200 only in a case in which the battery voltage Vb is below the threshold value Vth. For example, the predetermined value Vth is a threshold value for determining whether or not the voltage of the battery BT is sufficient and is set in advance. The fact that the voltage of the battery BT is sufficient means, for example, that the voltage is sufficiently high for the first voltage generation unit 21 to generate the first voltage V1. For example, the predetermined value Vth is a voltage value that is higher than a voltage obtained by adding a voltage to be dropped by the first voltage generation unit 21 to the first voltage V1.

For example, in a case in which the battery voltage Vb detected by the voltage detection unit 51 is below the predetermined value Vth, the switching control unit 52 outputs a switching signal to the switching unit 24. In a case in which the battery voltage Vb detected by the voltage detection unit 51 is equal to or greater than the predetermined value Vth, the switching control unit 52 stops outputting the switching signal to the switching unit 24. The switching unit 24 moves on to the second state only in a case in which the switching signal is received or is in the first state otherwise.

The drive control unit 53 includes a charging control unit 60, an energization control unit 61, and a regeneration control unit 62.

The charging control unit 60 controls the switch 32 such that it is brought into an ON state or an OFF state. The charging control unit 60 causes the bootstrap capacitor 41 to be charged by controlling the switch 32 in the ON state. In this manner, the bootstrap circuit 23 generates the boot voltage Vboot. For example, the charging control unit 60 executes intermittent charging of intermittently causing the bootstrap capacitor 41 to be charged, by controlling the switch 32 in the ON state at each of constant cycle times before a fuel is injected to the internal combustion engine mounted in the vehicle.

The energization control unit 61 controls the first switching element 25 in an ON state or an OFF state. Specifically, the energization control unit 61 generates a first gate signal for controlling the first switching element 25 and outputs the first gate signal to the gate of the first switching element 25. In this manner, the first switching element 25 is turned into the ON state.

The energization control unit 61 controls the second switching element 26 in an ON state or an OFF state. Specifically, the energization control unit 61 generates a second gate signal for controlling the second switching element 26 and outputs the second gate signal to the gate of the second switching element 26. In this manner, the second switching element 26 is turned into the ON state.

The energization control unit 61 controls the fourth switching element 28 in an ON state or an OFF state. Specifically, the energization control unit 61 generates a fourth gate signal for controlling the fourth switching element 28 and outputs the fourth gate signal to the gate of the fourth switching element 28. In this manner, the fourth switching element 28 is turned into the ON state.

The regeneration control unit 62 controls the third switching element 27 in an ON state or an OFF state. Specifically, the regeneration control unit 62 generates a third gate signal for controlling the third switching element 27 and outputs the third gate signal to the gate of the third switching element 27. In this manner, the third switching element 27 is turned into the ON state.

The current detection unit 54 includes a pair of input terminals, one of the input terminals is connected to one end of the current detection resistor 31, and the other input terminal is connected to the other end of the current detection resistor 31. A detection voltage generated by the current detection resistor 31 is input to the current detection unit 54, and the current detection unit 54 detects a detection current on the basis of the detection voltage. The current detection unit 54 outputs the detected detection current to the valve opening detection unit 55 and the drive control unit 53.

The valve opening detection unit 55 detects valve opening of the fuel injection valve L on the basis of the detection current input from the current detection unit 54. Specifically, the valve opening detection unit 55 detects that the fuel injection valve L has been opened, by specifying an inflection point of a first-order differential value or a second-order differential value of the detection current detected by the current detection unit 54.

Next, operations of the electromagnetic valve driving device 1 according to the present embodiment will be described.

Figure 4:
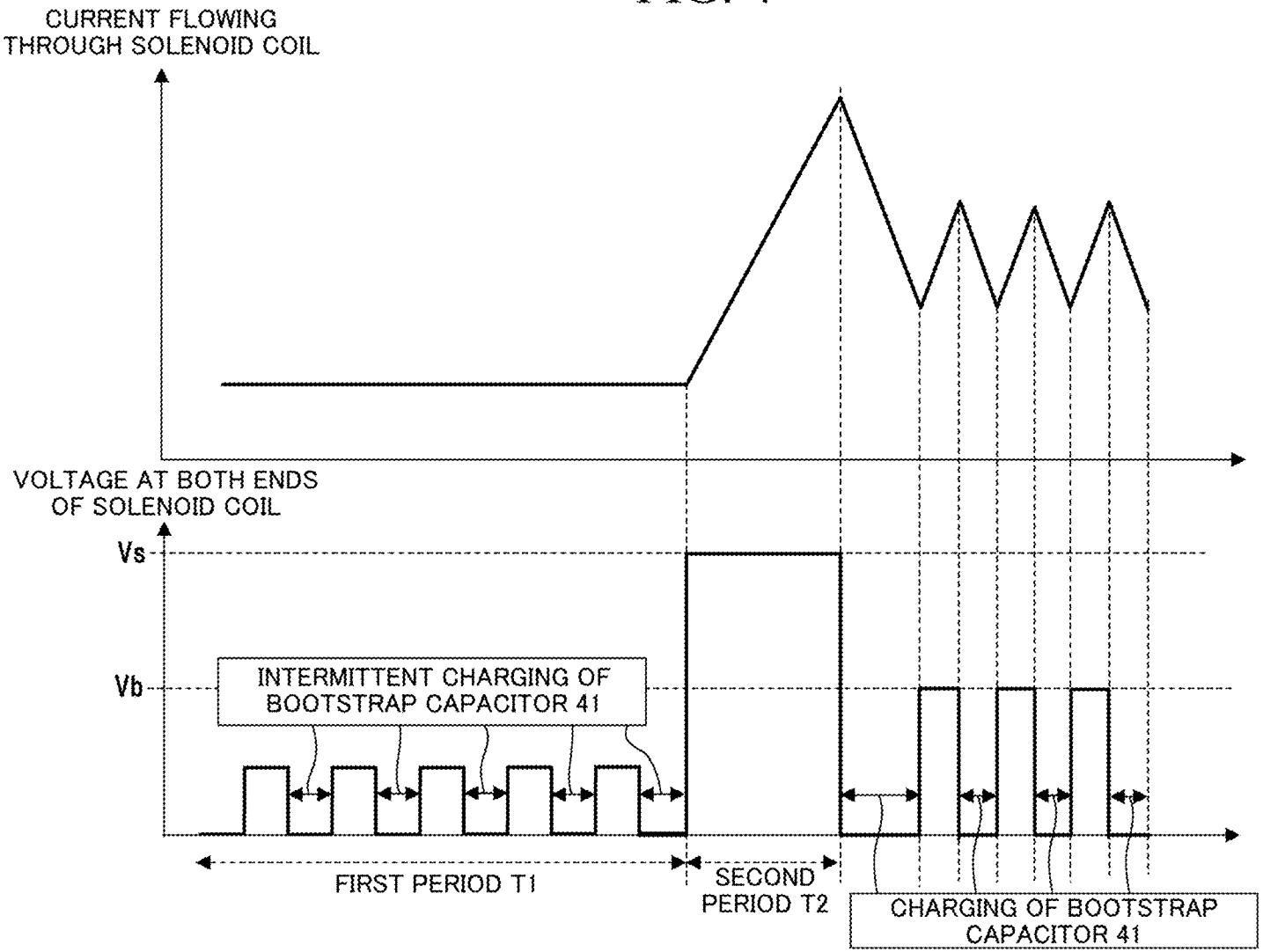
FIG. 4 is a diagram illustrating an operation timing of the electromagnetic valve driving device according to the embodiment.

As illustrated in FIG. 4, the control unit 35 charges the bootstrap capacitor 41 in a first period T1 before the fuel injection valve L is opened. Specifically, the switching control unit 52 determines whether or not the battery voltage Vb detected by the voltage detection unit 51 is equal to or greater than the predetermined value Vth, at every constant cycle. The switching control unit 52 constantly controls the switching unit 24 in the first state in a case in which the battery voltage Vb detected by the voltage detection unit 51 is equal to or greater than the predetermined value Vth. On the other hand, the switching control unit 52 controls the switching unit 24 in the second state in a case in which the battery voltage Vb detected by the voltage detection unit 51 is below the predetermined value Vth. The charging control unit 60 intermittently causes the bootstrap capacitor 41 to be charged by intermittently controlling the switch 32 in the ON state in the first period T1. In this manner, in the case in which the battery voltage Vb is equal to or greater than the predetermined value Vth, the first charging route 100 is formed, and the bootstrap circuit 23 generates the boot voltage Vboot from the power from the battery voltage Vb without intervention of the boost circuit 20.

For example, it is assumed that the battery voltage Vb is 14 V, the boosted voltage Vs is 65 V, and the first voltage V1 and the second voltage V2 are 10 V. In this case, if the bootstrap capacitor 41 is charged through the first charging route 100, then the voltage is caused to drop from 14 V to 10 V, and a power loss W1=4 V×I thus occurs. On the other hand, if the bootstrap capacitor 41 is charged through the second charging route 200, the voltage is caused to drop from 65 V to 10 V, and a power loss W2=55 V×I thus occurs. Therefore, the switching control unit 52 charges the bootstrap capacitor 41 through the second charging route 200 only in the case in which the battery voltage Vb is below the predetermined value Vth or charges the bootstrap capacitor 41 through the first charging route 100 otherwise. In this manner, the electromagnetic valve driving device 1 can stably generate the boot voltage Vboot while minimizing a power loss.

In a case in which the electromagnetic valve driving device 1 drives the fuel injection value L in a valve closed state to a valve opened state, the energization control unit 61 supplies the boosted voltage Vs generated by the boost circuit 20 to the fuel injection valve L in a second period T2 at the time of starting driving as illustrated in FIG. 4. In other words, the boost circuit 20 is caused to output the predetermined boosted voltage Vs by the boost control unit 50 outputting a boost control signal to the boost circuit 20 in the second period T2. For example, the second period T2 is a period until a current flowing through the solenoid coil 4 exceeds a preset threshold value after the boosted voltage Vs is supplied to the solenoid coil 4.

In the second period T2, the energization control unit 61 supplies the boosted voltage Vs to the first end of the solenoid coil 4 by outputting the first gate signal to the gate of the first switching element 25 and causes the second end of the solenoid coil 4 to be connected to the GND (reference potential) via the current detection resistor 31 by outputting the fourth gate signal to the fourth switching element 28.

As a result, the boosted voltage Vs that is relatively high as illustrated in FIG. 4 is supplied to the solenoid coil 4, and a peak-shaped rising drive current flows through the solenoid coil 4, in the second period T2. Such a drive current forms a magnetic path including the secured core 2 and the movable core 10, and the movable core 10 is caused to move to the side of the secured core 2 (upper side) due to an attraction force generated by the magnetic path. In other words, the needle 5 moves upward due to an attraction force caused by a drive current, and the valve body 6 is thus separated from the valve seat 3.

Here, the reason that the boosted voltage Vs, which is a higher voltage than the battery voltage Vb, is used in the second period T2 is to increase the speed of rising of the drive current and thus increase the speed of the valve opening operation of the fuel injection valve L. In other words, the valve opening speed of the fuel injection valve L is increased by the drive current as compared with a case in which the battery voltage is used, in the second period T2.

If the second period T2 elapses, the energization control unit 61 stops the output of the first gate signal and stops supply of the boosted voltage Vs to the solenoid coil 4. In this case, the first switching element 25, the second switching element 26, and the third switching element 27 are in an OFF state while the fourth switching element 28 is in an ON state.

If the supply of the boosted voltage Vs to the solenoid coil 4 is stopped by the energization control unit 61, then the regeneration control unit 62 causes a current (hereinafter, referred to as a "regenerative current") caused by a counter-electromotive force of the solenoid coil 4 to be regenerated at the GND by outputting the third gate signal to the gate of the third switching element 27.

Specifically, if the regeneration control unit 62 controls the third switching element 27 in an ON state, then the regenerative current caused by the counter-electromotive force flows through the GND via the GND, the third switching element 27, the solenoid coil 4, the fourth switching element 28, and the current detection resistor 31 due to the counter electromotive force generated by the solenoid coil 4. Note that, if the third switching element 27 is controlled in an ON state, the bootstrap capacitor 41 is charged with the first voltage V1 or the second voltage V2. In a case in which the switching unit 24 is in the first state, for example, the first charging route 100 for charging the bootstrap capacitor 41 is a route passing through the first voltage generation unit 21, the switching unit 24, the bootstrap circuit 23, the resistor 34, and the third switching element 27. In a case in which the switching unit 24 is in the second state, the second charging route 200 for charging the bootstrap capacitor 41 is a route passing through the second voltage generation unit 22, the switching unit 24, the bootstrap circuit 23, the resistor 34, and the third switching element 27.

An electromotive voltage of the solenoid coil 4 gradually decreases with elapse of time by the regenerative current flowing therethrough. Then, although the current flowing through the solenoid coil 4 is gradually attenuated as illustrated in FIG. 4 due to a decrease in electromotive voltage, which is a main reason, the movable core 10 continues to move to the side of the secured core 2 and finally collides against the secured core 2.

If the valve opening detection unit 55 detects valve opening of the fuel injection valve L, the energization control unit 61 causes the solenoid coil 4 to output the battery voltage Vb that is lower than the boosted voltage Vs. For example, the energization control unit 61 supplies the battery voltage Vb to the first end of the solenoid coil 4 and outputs the fourth gate signal to the fourth switching element 28 by outputting the second gate signal to the second switching element 26.

In this manner, if the valve opening detection unit 55 detects valve opening of the fuel injection valve L, the energization control unit 61 causes the solenoid coil 4 to output the battery voltage Vb that is lower than the boosted voltage to hold the valve opened state of the fuel injection valve L. At this time, the first switching element 25 and the third switching element 27 are in an OFF state while the second switching element 26 and the fourth switching element 28 are in an ON state.

Here, the energization control unit 61 performs current feedback control. At this time, a pulse width modulation (PWM) signal may be used as a control method. In a case in which the PWM signal is used, the energization control unit 61 supplies a PWM signal with a predetermined duty ratio as a second gate signal to the second switching element 26.

Therefore, the battery voltage Vb is successively supplied to the solenoid coil 4. Therefore, the bootstrap capacitor 41 is successively charged.

The duty ratio is set on the basis of the magnitude of the detection current detected by the current detection unit 54. In other words, the energization control unit 61 performs feedback control such that a held current for holding the valve opened state of the fuel injection valve L is maintained at a predetermined current value, by setting the duty ratio of the PWM signal on the basis of the magnitude of the detection current detected by the current detection unit 54. As a result, the valve opened state of the fuel injection valve L is held. Also, the drive current may be changed in a stepwise manner by changing the duty ratio in two levels.

The control unit 35 may cause the bootstrap capacitor 41 to be charged through the first charging route 100 when the fuel injection valve L is driven. The control unit 35 may cause the bootstrap capacitor 41 to be charged through the first charging route 100 in a period during which the fuel injection valve L is opened to inject the fuel. The period during which the fuel injection valve L is opened to inject the fuel may be, for example, a period after the second period T2 elapses.

Although the embodiment of the invention has been described in detail hitherto with reference to the drawings, the specific configuration is not limited to that in the embodiment and includes a design and the like without departing from the gist of the invention.

Figure 5:
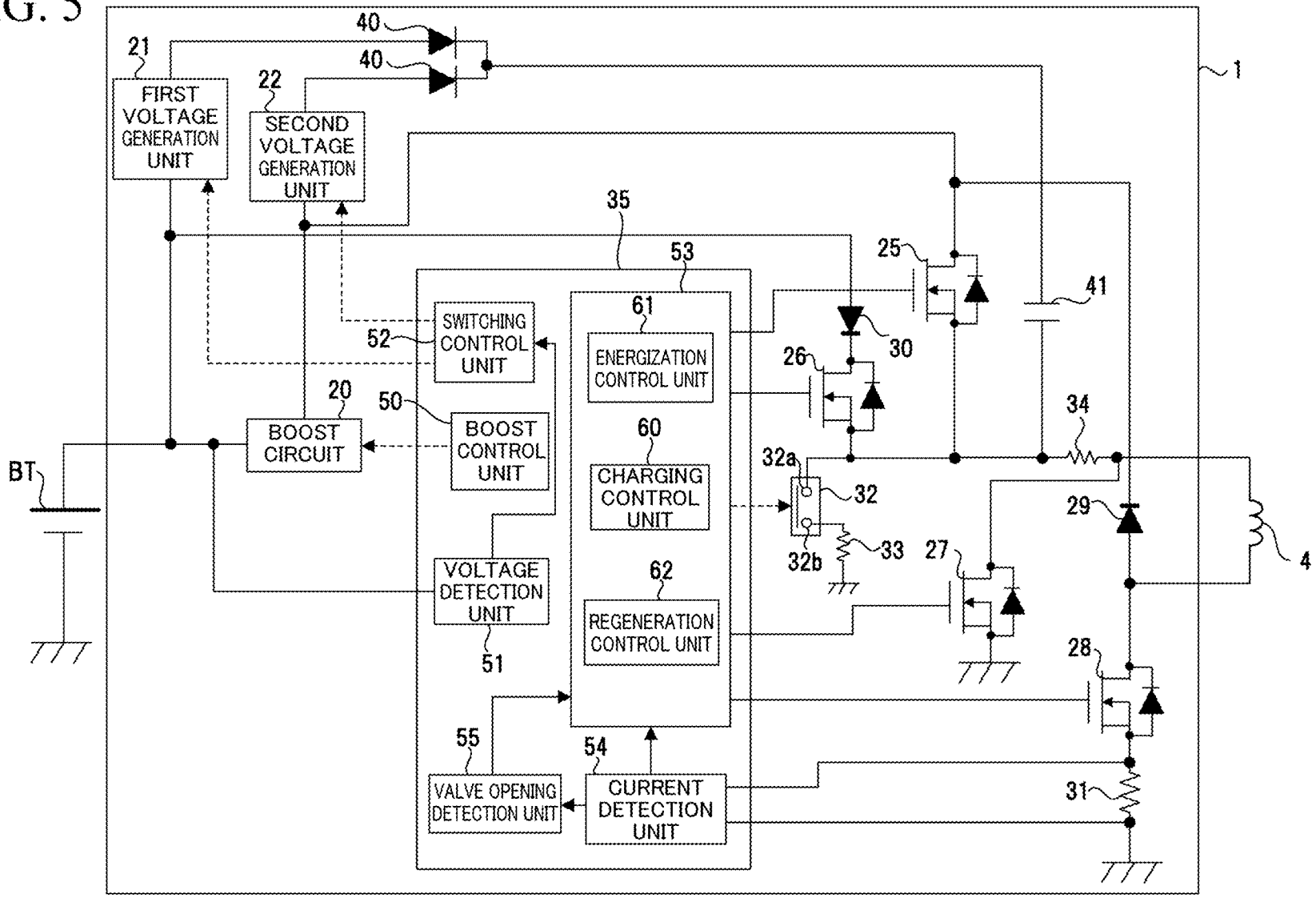
FIG. 5 is a circuit diagram illustrating a modification example of the electromagnetic valve driving device according to the embodiment.

For example, the electromagnetic valve driving device 1 may not include the switching unit 24. As illustrated in FIG. 5, for example, the switching control unit 52 may control operations of each of the first voltage generation unit 21 and the second voltage generation unit 22. The switching control unit 52 may control the route for charging the bootstrap capacitor 41 to the first charging route 100 by causing the first voltage generation unit 21 to operate and control the charging route to the second charging route 200 by causing the second voltage generation unit 22 to operate. In this case, the diode 40 may be provided at each of outputs from the first voltage generation unit 21 and the second voltage generation unit 22 as illustrated in FIG. 5.

As described above, the electromagnetic valve driving device 1 according to the present embodiment includes the first charging route 100 that charges the bootstrap capacitor 41 from the battery BT without intervention of the boost circuit 20, the second charging route 200 that charges the bootstrap capacitor 41 from the boost circuit 20, and the switching control unit 52 that switches the charging route for charging the bootstrap capacitor 41 to the first charging route 100 or the second charging route 200.

With such a configuration, it is possible to stably generate the boot voltage for controlling the high-side switching element in the ON state.

Also, the switching control unit 52 may switch the charging route from the first charging route 100 to the second charging route 200 only in a case in which the battery voltage Vb is below the predetermined value Vth. However, the invention is not limited to this configuration, and the switching control unit 52 may switch the charging route for charging the bootstrap capacitor 41 from the first charging route 100 to the second charging route 200 at an arbitrary timing. In other words, the switching control unit 52 ordinarily sets the first charging route 100 as the charging route for charging the bootstrap capacitor 41 and exceptionally switches the charging route from the first charging route 100 to the second charging route 200. The exception means, for example, a case in which the battery voltage Vb decreases for various reasons such as a vehicle traveling state or abnormality or becomes unstable. The decrease in the battery voltage Vb and the unstable battery voltage Vb may be detected by directly detecting the battery voltage Vb, may be detected indirectly on the basis of signals from various sensors provided in the vehicle or a vehicle traveling state, or may be predicted on the basis of signals from various sensors provided in the vehicle.

Note that an entirety or a part of the aforementioned drive control unit 53 may be realized by a computer. In this case, the computer may include a processor such as a CPU or a GPU and a computer-readable recording medium. Also, the entirety or the part of the functions of the drive control unit 53 may be realized by recording, in the aforementioned computer-readable recording medium, a program for realizing the entirety or the part of the functions the drive control unit 53 in the computer and causing the processor to read and execute the program recorded in the recording medium. Here, the "computer-readable recording medium" means a portable medium such as a flexible disk, a magneto-optical disc, a ROM, or a CD-ROM or a storage device such as a hard disk incorporated in a computer system. Furthermore, the "computer-readable recording medium" may include a recording medium that dynamically holds the program for a short period of time as a communication line in a case in which the program is transmitted via a network such as the Internet or a communication line such as a telephone line and a recording medium that holds the program for a specific period of time like a volatile memory inside the computer system that serves as a server or a client in such a case. The program may be for realizing a part of the aforementioned functions, may be able to realize the aforementioned functions in combination with a program that has already been recorded in the computer system, or may be realized using a programmable logic device such as an FPGA.

INDUSTRIAL APPLICABILITY

According to the electromagnetic valve driving device of the present invention, it is possible to stably generate a boot voltage for control of turning a high-side switching element into an ON state. High industrial applicability is thus achieved.

EXPLANATION OF REFERENCES

1 Electromagnetic valve driving device
21 First voltage generation unit
22 Second voltage generation unit
23 Bootstrap circuit
25 First switching element
26 Second switching element
27 Third switching element
28 Fourth switching element
35 Control unit
52 Switching control unit

What is claimed is:

1. An electromagnetic valve driving device that receives power from a battery and drives a fuel injection valve having a solenoid coil, the electromagnetic valve driving device comprising:

a boost circuit that boosts a battery voltage, which is an output voltage of the battery;

a first switching element that is disposed between the boost circuit and a first end of the solenoid coil;

a second switching element that is disposed between the battery and the first end;

a third switching element that is disposed between a second end of the solenoid coil and a ground;

a fourth switching element that is disposed between the first end and the ground;

a bootstrap capacitor that generates a voltage necessary to turn the first switching element and the second switching element into an ON state;

a first charging route that charges the bootstrap capacitor from the battery without intervention of the boost circuit;

a second charging route that charges the bootstrap capacitor from the boost circuit; and a switching control unit that switches a charging route for charging the bootstrap capacitor to the first charging route or the second charging route.

2. The electromagnetic valve driving device according to claim 1, further comprising:

a first voltage generation unit that is provided in the first charging route and generates a voltage for charging the bootstrap capacitor by dropping the battery voltage; and a second voltage generation unit that is provided in the second charging route and generates a voltage for charging the bootstrap capacitor by dropping a boosted voltage boosted by the boost circuit.

3. The electromagnetic valve driving device according to claim 2, wherein the switching control unit switches the charging route from the first charging route to the second charging route in a case in which the battery voltage is below a predetermined value.

4. The electromagnetic valve driving device according to claim 1, wherein the switching control unit switches the charging route from the first charging route to the second charging route in a case in which the battery voltage is below a predetermined value.

* * * * *